US006652241B1

(12) United States Patent
Alder

(10) Patent No.: US 6,652,241 B1
(45) Date of Patent: Nov. 25, 2003

(54) METHOD AND COMPRESSOR MODULE FOR COMPRESSING A GAS STREAM

(75) Inventor: Robert Alder, Gerasdorf (AT)

(73) Assignee: Linde, AG, Wiesbaden (DE)

( * ) Notice: Subject to any disclaimer, the term of this patent is extended or adjusted under 35 U.S.C. 154(b) by 0 days.

(21) Appl. No.: 10/031,567

(22) PCT Filed: Jul. 19, 2000

(86) PCT No.: PCT/EP00/06901

§ 371 (c)(1),
(2), (4) Date: May 28, 2002

(87) PCT Pub. No.: WO01/06123

PCT Pub. Date: Jan. 25, 2001

(30) Foreign Application Priority Data

Jul. 20, 1999 (DE) ..... 199 33 989

(51) Int. Cl.[7] ..... F04B 23/14

(52) U.S. Cl. ..... 417/53; 417/85; 417/244; 165/120; 165/138

(58) Field of Search ..... 417/53, 85, 243, 417/244; 165/120, 121, 138, 144

(56) References Cited

U.S. PATENT DOCUMENTS 3,441,200 A * 4/1969 Huesgen ..... 230/5
4,279,574 A * 7/1981 Kunderman ..... 417/243
4,362,462 A * 12/1982 Blotenberg ..... 415/1
4,653,986 A * 3/1987 Ashton ..... 417/243
5,863,186 A 1/1999 Green et al.

OTHER PUBLICATIONS

Elsevier Science Ltd, 1995, Elsevier, 9$^{th}$, p. 481.*

* cited by examiner

*Primary Examiner*—Charles G. Freay
*Assistant Examiner*—John F. Belena
(74) *Attorney, Agent, or Firm*—Millen, White, Zelano & Branigan, P.C.

(57) ABSTRACT

The invention relates to a method and compressor module for compressing a gas stream of entry temperature $t_1$ with the aid of hydraulically driven piston compressors in two compression stages of an entry pressure $p_1$ from an intermediate pressure $p_2$ after the first compression stage and from intermediate pressure $p_2$ to an exit pressure $p_3$ after the second compression stage, whereby the gas stream compressed to the intermediate pressure $p_2$ is cooled back down to the entry temperature $t_1$ before entering the second compression stage, and identical pressure ratios $p_3/p_2=p_2/p_1$ are used in the compression stage. According to the invention, the pressure ratios are adjusted by correspondingly adapting a hydraulic fluid stream for driving the first compression stage and a hydraulic fluid stream for driving the second compression stage with regard to the flow rate thereof with the aid of two adjustable hydraulic fluid pumps.

16 Claims, 1 Drawing Sheet

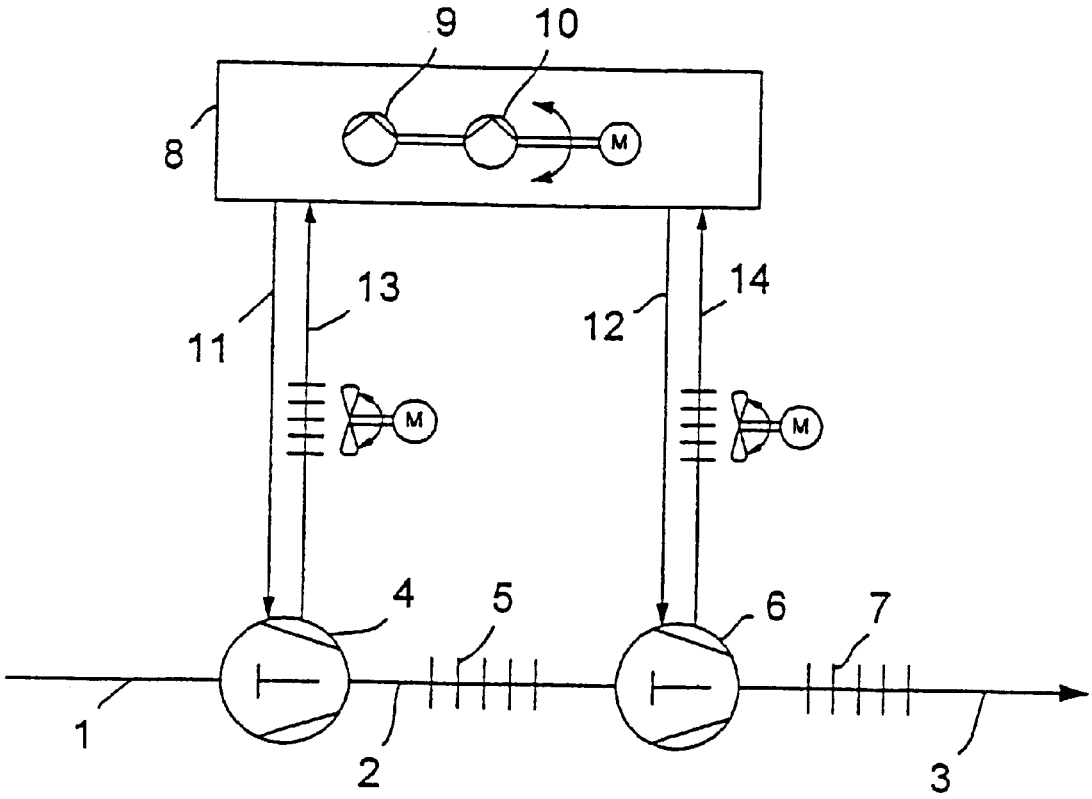
Fig.

METHOD AND COMPRESSOR MODULE FOR COMPRESSING A GAS STREAM

The invention relates to a process for compressing a gas stream of entry temperature $t_1$ with the help of hydraulically driven piston compressors in two compression stages from an entry pressure $p_1$ to an intermediate pressure $p_2$ after the first compression stage and from intermediate pressure $p_2$ to an exit pressure $p_3$ after the second compression stage, wherein the gas stream compressed to intermediate pressure $p_2$ is cooled back down to entry temperature $t_1$ before entry into the second compression stage and identical pressure ratios, $p_3/p_2=p_2/p_1$, are used in the compression stages.

The invention further relates to a compressor module for performing the process according to the invention with a two-stage compressor part, a drive part, and a power transfer between the compressor part and the drive part over lines with hydraulic fluid.

Piston compressors according to the prior art, which, for example, compress from 1 bar to 300 bars, are built with 3 or 4 stages and driven by a common piston shaft. With a three-stage machine and cooling between the stages, a stage pressure ratio of 6.7 is selected and compression is done from 1 bar in the first stage to 6.7 bars in the second stage to 44.9 bars and in the third stage to 300 bars. The entry pressure can be varied only within very narrow ranges. This is a drawback if the entry gas is made available from a pipeline with 7 bars of pipeline pressure instead of from a gasometer. Another compressor is used that operates at a stage pressure ratio of 3.5 bars.

Thus the object of the invention is to indicate a process and a compressor module for compressing a gas stream that guarantees that a definite, for example constant, final pressure will be reached even at widely varying starting pressure of the available gas, and the same machines are used economically from an energy viewpoint.

This object is achieved according to the invention by a process with the features of claim 1 and by a compressor module with the features of claim 6. Embodiments of the invention are the object of subclaims.

The distinguishing feature of the process according to the invention is that the pressure ratios are adjusted by using the help of two adjustable hydraulic oil pumps accordingly to match, with respect to their flow rate, a hydraulic stream for driving the first compression stage and a hydraulic stream for driving the second compression stage. At an entry pressure that changes from 1 bar to 7 bars, the hydraulic oil stream for the first stage is reduced and the oil stream for the second stage is increased until both stages are operated with the same pressure ratio which, assuming an ideal gas to compress, is the most economical from an energy viewpoint. Because of deviations of the properties of real gases from the ideal gas, and with incomplete cooling down to $t_1$, it can be useful, at almost the same stage pressure ratios, to seek still a more economical operation from an energy viewpoint by experimenting with slight changes in the pressure ratios of the stages. This post-optimization is indeed well known to one skilled in the art, but it can be performed especially easily with the help of the drive according to the invention.

In one configuration of the process according to the invention, the gas stream to be compressed can contain methane or hydrogen or a mixture of methane and hydrogen.

The gas stream to be compressed can contain, for example, a natural gas or a methane-containing fraction of a natural gas.

A variable pressure between 1 and 10 bars can be used as entry pressure $p_1$. In this pressure range, the gas stream to be compressed is almost always made available per pipeline.

A stationary pressure between 250 and 350 bars can be used as exit pressure $p_3$. This is a favorable precondition for filling a pressure tank, a pressure gas bottle or temporary storage.

A distinguishing feature of the compressor module according to the invention is that the drive part for each compressor stage contains a hydraulic fluid pump, each with an adjusting device for the flow rate of the hydraulic fluid. Separate adjustment of the flow rate makes it possible to set the same pressure ratio or postoptimized stage pressure ratios (see above) in both stages and, at the exit of the second stage, precisely the necessary final pressure of the gas to be compressed.

In one configuration of the compressor module according to the invention, the compressor stages can be provided with one fluid-cooled piston compressor each and one aftercooler each. This makes it possible to have an almost isothermic compression and to set approximately the same entry temperature in both compressor stages. This leads to a lower specific compressor power. The aftercooler of the second compressor stage simplifies the filling of a containers subsequent to the compression without heating the latter too greatly.

Every piston compressor can be provided with two working cylinders. The pulsations in the pressure-carrying lines are then especially low.

Cylinder bearing surfaces of the working cylinders can be supplied from without and from within with hydraulic fluid. Cooling is then especially effective.

The hydraulic fluid lines can lead to at least one air-cooled aftercooling device for the hydraulic fluid. One like this has an especially simple design and represents no additional concerns about noise when operated without ventilators, i.e., with natural convection.

The process according to the invention can be used with at least one of the compressor modules according to the invention in a natural gas filling station. A surface-covering entry from natural gas filling stations is favored especially by the fact that, with the invention, the gas to be compressed, in this case the gaseous fuel for vehicles, is withdrawn from pipelines operating at varying pressure and still, with the help of piston compressors of the same type and size, can be compressed.

It can be necessary that the fuel to be compressed must be cleansed of particles and dried in advance. After compression an intermediate storage vessel is useful, from which vehicles can then be filled.

The invention will be explained based on one embodiment with a figure. The process data shown by way of example refer to a use of the invention at a natural gas filling station, i.e., with natural gas as the gas stream to be compressed.

The natural gas is withdrawn from a pipeline and processed to the extent necessary for operation in internal combustion engines: For example, particles are removed and the natural gas is dried to less than 10 mole-ppm. (This processing is not shown in the figure.) As gas stream 1 to be compressed, the natural gas processed this way is compressed at approximately ambient temperature $t_1$ and with an entry pressure $p_1$=3 bars by a hydraulically driven piston compressor 4 of the first compression stage to an intermediate pressure of $p_2$=30 bars, and the temperature of gas stream 2 can reach about 120° C. Piston compressor 4 has two working cylinders whose cylinder surfaces are cooled with hydraulic fluid at about 60° C. Gas stream 2 is cooled in an air cooler 5 that is downstream from piston compressor 4 to $t_2$=40° C. and fed to piston compressor 6 of the second compression stage, then compressed to a final pressure, recooled in another air cooler 7 and fed with a final pressure $p_3$=300 bars and a temperature of $t_3$=40° C. to a high pressure gas accumulator not shown in the figure. The piston compressor of the second compression stage is driven in the same way and cooled like the one in the first compression stage. Piston compressors 4, 6 are driven at a stage pressure ratio of $p_3/p_1=p_2/p_1=10$. For this purpose they are supplied from a drive part 8 with the help of two independently controllable variable piston pumps 9, 10, each with a pressure medium stream 11, 12. The pressure medium can be a hydraulic fluid, is also used as cooling agent and is thus cooled in return current 13, 14 from piston compressors 4, 6.

The compressor module is advantageously built so that the drive part and a compression part (with the compressor stages) are each mounted on a base frame and each placed in a cabinet. Several compressor modules can be used in one natural gas filling station.

What is claimed is:

1. A process comprising compressing a gas stream of entry temperature $t_1$ with the help of hydraulically driven piston compressors in two compression stages from an entry pressure $p_1$ to an intermediate pressure $p_2$ after the first compression stage and from intermediate pressure $p_2$ to an exit pressure $p_3$ after the second compression stage, and the gas stream compressed to intermediate pressure $p_2$ is cooled to entry temperature $t_1$ before entry into the second compression stage and identical pressure ratios $p_3/p_2=p_2/p_1$ are used in the compression stages, characterized in that the pressure ratios are adjusted accordingly by matching a hydraulic fluid stream for driving the first compression stage and a hydraulic fluid stream for driving the second stage with respect to their flow rate, with the help of two adjustable hydraulic fluid pumps.

2. A process according to claim 1, wherein the gas stream to be compressed contains methane or hydrogen or a mixture of methane and hydrogen.

3. A process according to claim 1, wherein the gas stream to be compressed contains a natural gas or a methane-containing fraction of a natural gas.

4. A process according to claim 1, wherein a pressure between 1 and 10 bars is used as entry pressure $p_1$.

5. A process according to claim 1, comprising adjusting the pressure ratios by adjusting two independently controllable variable piston pumps.

6. A process according to claim 1, comprising adjusting the two adjustable hydraulic fluid pumps so as to act directly on the hydraulic fluid streams.

7. A compressor module comprising a two-stage compressor part, a drive part and a power transfer between the compressor part and the drive part over lines with hydraulic fluid, characterized in that the drive part for each compressor stage contains a hydraulic fluid pump each with an adjustment mechanism for conveying the hydraulic fluid.

8. A compressor module according to claim 7, wherein the compressor stages each are provided with a fluid-cooled piston compressor and a recooler.

9. A compressor module according to claim 8, wherein each piston compressor is provided with two working cylinders.

10. A compressor module according to claim 9, wherein cylinder bearing surfaces of the working cylinders are supplied from the outside and inside with hydraulic fluid for cooling.

11. A compressor module according to claim 8, wherein the hydraulic fluid lines carry at least one air-cooled after-cooling device for the hydraulic fluid.

12. A natural gas filling station comprising at least one compressor module according to claim 7.

13. A compressor module according to claim 9, wherein the hydraulic fluid lines carry at least one air-cooled after-cooling device for the hydraulic fluid.

14. A compressor module according to claim 10, wherein the hydraulic fluid lines carry at least one air-cooled after-cooling device for the hydraulic fluid.

15. A process comprising compressing a gas stream of entry temperature $t_1$ with the help of hydraulically driven piston compressors in two compression stages from an entry pressure $p_1$ to an intermediate pressure $p_2$ after the first compression stage and from intermediate pressure $p_2$ to an exit pressure $p_3$ after the second compression stage, and the gas stream compressed to intermediate pressure $p_2$ is cooled to entry temperature $t_1$ before entry into the second compression stage and identical pressure ratios $p_3/p_2=p_2/p_1$ are used in the compression stages, characterized in that the pressure ratios are adjusted accordingly by matching a hydraulic fluid stream for driving the first compression stage and a hydraulic fluid stream for driving the second stage with respect to their flow rate, with the help of two adjustable hydraulic fluid pumps with the proviso that a pressure between 250 and 350 bars is used as exit pressure $p_3$.

16. A process according to claim 15, wherein a pressure between 1 and 10 bars is used as entry pressure $p_1$.

* * * * *

UNITED STATES PATENT AND TRADEMARK OFFICE

CERTIFICATE OF CORRECTION

PATENT NO. : 6,652,241 B2
DATED : November 25, 2003
INVENTOR(S) : Robert Adler

It is certified that error appears in the above-identified patent and that said Letters Patent is hereby corrected as shown below:

Title page,
Item [75], Inventor, "Robert Alder," should read -- Robert Adler --

Signed and Sealed this

Twenty-fourth Day of August, 2004

JON W. DUDAS
*Director of the United States Patent and Trademark Office*